United States Patent [19]

Williams

[11] 4,174,146

[45] Nov. 13, 1979

[54] ADAPTER FOR ROUTING ELECTRICAL WIRES

[76] Inventor: Robert A. Williams, 55 Bounty Rd., East, Fort Worth, Tex. 76116

[21] Appl. No.: 916,283

[22] Filed: Jun. 16, 1978

[51] Int. Cl.[2] ..... H01R 13/46

[52] U.S. Cl. ..... 339/143 R

[58] Field of Search ..... 339/143 R, 143 S, 143 T, 339/89 R, 182 R, 182 S, 182 T, 196 R, 196 M; 174/81, 84 C, 87

[56] References Cited

U.S. PATENT DOCUMENTS

| | | | |
|---|---|---|---|
| 3,237,146 | 2/1966 | Barker | 339/196 M X |
| 3,375,481 | 3/1968 | Parnell | 339/196 M X |

*Primary Examiner*—Joseph H. McGlynn

*Assistant Examiner*—John S. Brown

*Attorney, Agent, or Firm*—Wofford, Fails, & Zobal

[57] ABSTRACT

An adapter for routing shielded electrical wires to a connector and which comprises a plurality of spacer-shield connecting member pairs located between a base of a socket and an end plate. The spacers and shield connecting members have square central openings which are aligned with openings formed through the base and socket. Each spacer has a side opening for receiving the wires which are routed through the openings of the base and socket. The shields of the wires are connected to tabs formed on the shield connecting members. The end plate, spacers, shield connecting members, and base each has four apertures which define the four corners of a square for receiving connecting means for securing the components together.

3 Claims, 4 Drawing Figures

FIG. 1
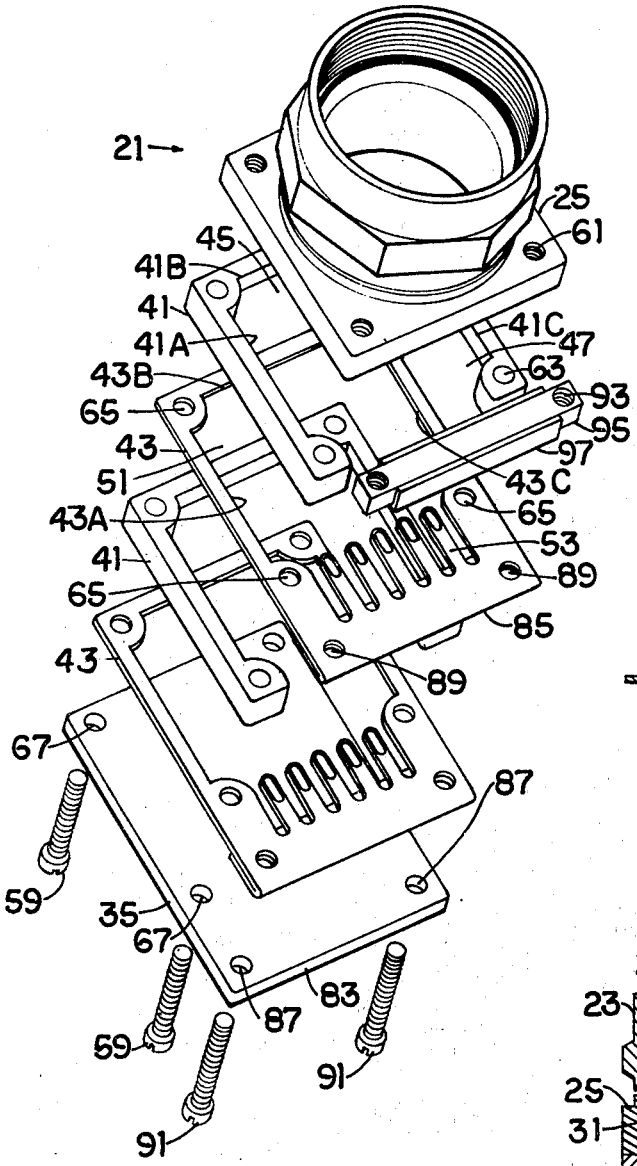
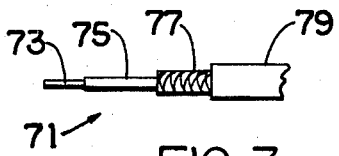
FIG. 3
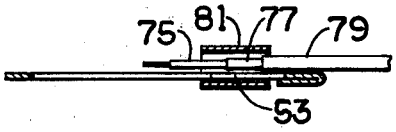
FIG. 4
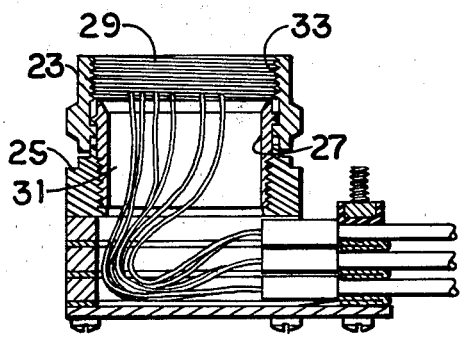
FIG. 2

ADAPTER FOR ROUTING ELECTRICAL WIRES

BACKGROUND OF THE INVENTION

1. Field of the Invention

This invention relates to an adapter for routing shielded electrical wires to a connector and for terminating their shields.

2. Description of the Prior Art

Horseshoe shaped adapters for routing electrical wires through angles of 90° to a connecter have been used, however, these adapters have disadvantages since they do not provide enough working room for the wires and moreover allow the wires to be brought in from only one direction.

SUMMARY OF THE INVENTION

It is an object of the present invention to provide an adapter with maximum working room for routing a plurality of shielded electrical wires to a connecter.

It is a further object of the present invention to provide a right angled adapter having a rectangular configuration for providing maximum working room for routing a plurality of shielded electrical wires to a connector.

It is another object of the present invention to provide such an adapter having a plurality of spacer-shield connecting member pairs which may be located in different directions to route a plurality of shielded electrical wires to a connecter from different directions.

BRIEF DESCRIPTION OF THE DRAWINGS

FIG. 1 is an exploded view of the adapter of the present invention;

FIG. 2 is a cross-sectional side view of the adapter of FIG. 1 assembled but with a different number of spacer-shield connecting member pairs;

FIG. 3 illustrates an end of a shielded electrical wire or cable; and

FIG. 4 illustrates one manner of connecting the shield of an electrical wire to one of the tabs of one of the shield connecting members.

DESCRIPTION OF THE PREFERRED EMBODIMENT

Referring now to the drawings, reference numeral 21 identifies the adapter of the present invention. It may be defined as a shield terminating adapter for routing electrical wires through a 90° bend to a connector. The adapter comprises an annular socket 23 rotatably connected to a rectangular shaped base 25, the latter of which comprises an annular member 27 threaded into the base. Member 27 holds the socket 23 yet allows it to rotate relative to the base. Both the socket 23 and the base 25 have aligned openings 29 and 31 formed therethrough. The socket 23 has female threads 33 formed therein to allow it to be threaded to an electrical connector (not shown). Socket 23, base 25 and member 27 are formed of metal.

Also provided, is a rectangular shaped end plate 35 and a plurality of rectangular shaped spacer-shield connecting member pairs adapted to be secured between the base 25 and the end plate 35. The spacer of each pair is identified at 41 and the shield connecting member of each pair is identified at 43. The spacers 41, shield connecting members 43 and end plate 35 are formed of metal. The adapter, shown in FIG. 1, employs two spacer-shield connecting member pairs while the adapter shown in FIG. 2 employs three spacer-shield connecting member pairs. The spacers 41 and the base 25 define squares which are equal to each other. The width and length of the shield connecting members 43 are equal respectively to the width and length of the end plate 35. The widths of members 43 and end plate 35 are equal to the dimensions of the sides of the spacers 41 and base 25, however, their lengths are greater.

The spacers 41 are identical to each other. Each spacer 41 has a central opening 45 formed therethrough with a side opening 47 extending from one side to the opening 45. The opening 45 is square in shape and is defined by straight edges 41A, 41B, and 41C. Edges 41A and 41C are parallel to each other and perpendicular to edge 41B.

The shield connecting members 43 also are identical to each other. Each shield connecting member 43 has a central opening 51 formed therethrough and a plurality of spaced apart tab members 53 extending from one side toward the opening 51. The opening 51 is square in shape and is defined by straight edges 43A, 43B and 43C and by tabs 53. Edges 43A and 43C are parallel to each other and perpendicular to edge 43B.

The square openings 45 of the spacers 41 are equal in size to the square openings 51 of the shield connecting members 43. The base 25, each of the spacers 41, each of the shield connecting members 43, and the end plate 35 each has four apertures formed therethrough defining four corners of a square for receiving threaded bolts 59 for securing the component together to form the assembled adapter. The four apertures of the base 25, the spacers 41, the shield connecting members 43, and the end plate 35 are identified at 61, 63, 65, and 67, respectively. Apertures 61 are threaded while apertures 63, 65 and 67 are large enough to slidably receive the bolts 59. When the spacer-shield connecting member pairs are located between the base 25 and end plate 35, the apertures 61, 63, 65 and 67 of each corner will be alignment for receiving the bolts to allow them to be threaded into the apertures 61.

When the spacer-shield connecting pairs are secured between the base 25 and end plate 35, the spacers will alternate in position with the shield connecting members and the tabs 53 of each shield connecting member will be located such that they are in alignment with the side opening 47 of its associated spacer. Thus, the electrical wires may extend through the side opening 47 of each spacer-shield connecting member pair with the shield of each wire connected to one of the tabs 53.

A typical shielded electrical wire is identified at 71 in FIG. 3. It comprises a copper strand or strands 73 covered with an insulating layer 75. Located around the insulating layer 75 is a metallic shield 77 which is covered by an outer insulating layer 79. The shield 77 of an electrical wire may be connected or grounded to a tab 53 by locating an exposed portion of the shield 77 over a tab 53; placing a metallic ferrule 81 around the shield and tab; and crimping the ferrule.

The insulated strands 73, 75 then are routed into the openings 45, 51 of the spacer-shield connecting member pairs defining the adapter; formed into a 90° angle; and then routed through the openings 29, 31 of the socket and base for connection to a connecter.

Formed through the end plate 35 and through the shield connecting members 43 near their ends 83 and 85 are apertures 87 and 89, respectively, for receiving bolts 91 which are then threaded into threaded apertures 93 formed through a bar 95 for providing strain relief for the wires routed into the adapter. Member 97 is a resilient padding member.

Since the space formed by the openings 41, 51 is square in shape, increased working space is provided allowing stiff wire to be bent at 90° without interweaving the wires which rapidly increases the bulk. In FIG. 2, a wire hinge plan is shown in which each tier or waffer fits into a planned area of the adapter and a wire hinge point is established to allow the wire to bend in a tight, but not too small radius and still fit within the required confinement.

Adapters have been used in which the spacers 41 and shield connecting members 43 are of a horseshoe configuration and are connected together with three bolts. In these adapters, only three bolt receiving apertures are formed through each of base, spacers, shield connecting members and end plates at positions which define a triangle having to equal sides. This adapter has disadvantages since approximately 30% of vital wire hinge point area within the adapter is lost due to the horseshoe configuration of the interior space. In addition, wires may be brought in from only one direction whereas in the adapter of the present invention, wires may be brought in from a plurality of directions. For example, in the adapter of FIG. 1, the spacer-shield connecting member pair shown next to the end plate 35 may be located as shown, however, the spacer-shield connecting member pair shown next to the base 25 may be turned 90° from that shown to allow wires to be brought in from two directions 90° with respect to each other. This is possible, since the base, spacers, shield connecting members, and end plate have four bolt receiving apertures 61, 63, 65, and 67 which define a square and, hence, allow any of the spacer-shield connecting member pairs to be positioned with their side opening 47 and tabs 53 located on any of the four sides of the base 25.

Although not shown, it is to be understood that the adapter may employ only one spacer-shield connecting member pairs.

What is claimed is:

1. An adapter for routing electrical wires to a connector, comprising:

an annular socket means having a rectangular shaped base with an opening formed through said base in alignment with the opening of said socket means, a rectangular shaped end plate, at least one rectangular shaped spacer having a central opening and a side opening extending from one side to said central opening, said central opening being generally rectangular in shape and defined by three straight edges, one of which is opposite said side opening and the other two being parallel to each other and perpendicular to said one end, at least one rectangular shaped shield connecting member having a central opening and a plurality of spaced apart tab members extending from one side toward said central opening, said central opening of said shield connecting member being generally rectangular in shape and defined by three straight edges and said tabs, one of said straight edges being opposite said tabs and the other two being parallel to each other and perpendicular to said one edge, said spacer and said shield connecting member being adapted to be located between said base of said socket means and said end plate in an operative position with their central openings in alignment with said openings of said socket means and said base and with said tab members of said shield connecting member in alignment with said side opening of said spacer, each of said base, spacer, shield connecting member and end plate having four apertures formed therethrough defining the four corners of a square whereby said four apertures of said base, spacer, shield connecting member and end plate respectively are in alignment for receiving connecting means when said spacer and said shield connecting member are located between said base and said end plate in said operative position, the side opening of said spacer being adapted to receive electrical wires of the type having shields, for routing through said openings of said base and socket means with said shields being connected to said tab members.

2. The adapter of claim 1 comprising:

means for securing said wires to said end plate at a position outside of said side opening of said spacer.

3. An adapter for routing wires to a connector, comprising:

an annular socket means having a rectangular shaped base with an opening formed through said base in alignment with the opening of said socket means, a rectangular shaped end plate, a plurality of even numbered rectangular shaped spacers each having a central opening and a side opening extending from one side to said central opening, said central opening of each of said spacers being generally rectangular in shape and defined by three straight edges one of which is opposite said side opening and the other two being parallel to each other and perpendicular to said one side, a plurality of rectangular shaped shield connecting members equal in number to the number of said spacers, each of said shield connecting members having a central opening and a plurality of spaced apart tab members extending from one side toward said central opening, said central opening of each of said shield connecting members being generally rectangular in shape and defined by three straight edges and said tabs, one of said straight edges being opposite said tabs and the other two being parallel to each other and perpendicular to said one edge, said spacers and said shield connecting members being adapted to be located between said base of said socket means and said end plate alternately in pairs in operative positions with their central openings in alignment with said openings of said socket means and said base and with said tab members of each shield connecting members in alignment with said side opening of its associated spacer, each of said base, spacers, shield connecting members and end plate having four apertures formed therethrough defining the four corners of a square whereby said four apertures of said base, spacers, shield connecting members and end plate respectively are in alignment for receiving connecting means when said spacers and said shield connecting members are located between said base and said end plate alternately in pairs in said operative positions, the side openings of each of said spacers being adapted to receive electrical wires of the type having shields for routing through said openings of said base and socket means with said shields being connected to said tab members of the associated shield connecting member.

* * * * *